US010799859B2

(12) United States Patent
Dudek et al.

(10) Patent No.: US 10,799,859 B2
(45) Date of Patent: Oct. 13, 2020

(54) CONTROL BUTTON FOR A SAMPLING PIPETTE

(71) Applicant: GILSON SAS, Villiers-le-bel (FR)

(72) Inventors: Bruno Dudek, Orry la Ville (FR); Sanjay Ramsamy, Sarcelles (FR)

(73) Assignee: GILSON SAS, Villiers-le-Bel (FR)

( * ) Notice: Subject to any disclaimer, the term of this patent is extended or adjusted under 35 U.S.C. 154(b) by 306 days.

(21) Appl. No.: 15/739,012

(22) PCT Filed: Jun. 21, 2016

(86) PCT No.: PCT/EP2016/064246
§ 371 (c)(1),
(2) Date: Dec. 21, 2017

(87) PCT Pub. No.: WO2016/207131
PCT Pub. Date: Dec. 29, 2016

(65) Prior Publication Data

US 2018/0178211 A1 Jun. 28, 2018

(30) Foreign Application Priority Data

Jun. 24, 2015 (FR) ..... 15 55833

(51) Int. Cl.
*B01L 3/02* (2006.01)

(52) U.S. Cl.
CPC ..... *B01L 3/0237* (2013.01); *B01L 3/0217* (2013.01); *B01L 3/0286* (2013.01);
(Continued)

(58) Field of Classification Search
CPC .... B01L 3/0237; B01L 3/0217; B01L 3/0286; B01L 2200/0605; B01L 2200/087;
(Continued)

(56) References Cited

U.S. PATENT DOCUMENTS 9,440,230 B2 9/2016 Baron
2005/0155438 A1* 7/2005 Belgardt ..... B01L 3/0217 73/864.01

(Continued)

FOREIGN PATENT DOCUMENTS

FR 2 986 718 A1 8/2013
WO 01/76749 A1 10/2001

OTHER PUBLICATIONS

International Search Report issued to PCT/EP2016/064246 dated Jul. 22, 2016.

(Continued)

*Primary Examiner* — Jill A Warden
*Assistant Examiner* — Brittany I Fisher
(74) *Attorney, Agent, or Firm* — Pearne & Gordon LLP

(57) ABSTRACT

A control button (12) for a manually actuated sampling pipette, the button including lower and upper parts (24*a*, 24*b*), one of which is equipped with a force sensor (31) and the other with an actuating member (30). In the vertical position of the button, in a state not subjected to a force, not only does the member (30) ensure that the upper part is retained axially on the lower part (24*a*), but these parts also define a circular axially retaining connection (42) therebetween, the circular connection exhibiting an axial clearance (47) configured such that, when a pressure is exerted on an off-centre action zone (102*a*) by the thumb of an operator, the axial clearance (47) is taken up in this zone (102*a*), while the connection (42) retains a reaction zone (102*b*), arranged diametrically opposite the action zone (102*a*), axially and locally relative to the lower part (24*a*).

17 Claims, 7 Drawing Sheets

(52) U.S. Cl.
CPC . *B01L 2200/0605* (2013.01); *B01L 2200/087* (2013.01); *B01L 2200/143* (2013.01); *B01L 2200/146* (2013.01); *B01L 2300/023* (2013.01); *B01L 2300/025* (2013.01); *B01L 2300/0627* (2013.01); *B01L 2300/08* (2013.01); *B01L 2300/123* (2013.01)

(58) Field of Classification Search
CPC ..... B01L 2200/143; B01L 2200/146; B01L 2300/025; B01L 2300/0627; B01L 2300/08; B01L 2300/123; B01L 2300/023
USPC ..... 422/501, 518, 521, 522
See application file for complete search history.

(56) References Cited

U.S. PATENT DOCUMENTS

2011/0132110 A1* 6/2011 Kimura ..... B01L 3/0224 73/864.01
2015/0004078 A1* 1/2015 Baron ..... B01L 3/0217 422/521

OTHER PUBLICATIONS

Preliminary French Search Report issued to French Application No. FR 15 55833 dated Apr. 25, 2016.

* cited by examiner

CONTROL BUTTON FOR A SAMPLING PIPETTE

This is a National Stage application of PCT international application PCT/EP2016/064246, filed on Jun. 21, 2016 which claims the priority of French Patent Application No. 15 55833 entitled "IMPROVED CONTROL BUTTON FOR A SAMPLING PIPETTE", filed Jun. 24, 2015, both of which are incorporated herein by reference in their entirety.

TECHNICAL FIELD

The invention relates to the field of sampling pipettes, also called laboratory pipettes or even liquid transfer pipettes, for sampling and dispensing liquid in containers or the like.

The pipettes concerned by the present invention are manually actuated pipettes. These pipettes are intended to be held in the hand by an operator during liquid sampling and dispensing operations, these operations being performed by the setting in motion of a control button obtained by applying an actuating pressure on the same button.

More specifically, the invention relates to a control button equipping this pipette type, the button being equipped with a force sensor intended to detect the force exerted by the operator's thumb on the button, during pipetting operations. By way of indicating but in no way limiting example, this force sensor can be useful for detecting a passage of the piston through a predetermined position along its dispensing stroke or its purging stroke.

STATE OF PRIOR ART

Being capable of detecting the passage of the piston through a predetermined position turns out to be interesting in several respects. For example, that makes it possible to ensure counting the number of pipetting operations performed with a same pipette, as is described in particular in documents WO01/76749 and FR 2 986 718.

On the other hand, it turned out to be interesting to implant a force sensor within a control button of the pipette. Such a sensor is capable of delivering a signal proportional to the force exerted by the operator's thumb on the button. This sensor thus enables a detection of a passage of the piston through a predetermined position along its dispensing stroke or its purging stroke, as well as many other applications, to be implemented.

However, the measurement of the pressure force exerted by the operator's thumb can be distorted by the fact that this force is often not applied along the central axis of the button, but exerted in an off-centred way. This off-centring of the force can in particular result in decreasing the force detected by the sensor, whereas at the same time, the desired application can require a high detection threshold to provide this application with a proper operation. That is in particular the case for the detection of a passage of the piston through a predetermined position along its dispensing stroke or its purging stroke.

A detection reliability problem results therefrom. This problem is all the more complicated to solve that the button off-centred action zone, on which the operator's pressure is exerted, can differ at each new pipetting operation because of the rotary character of the upper part of the button on which the pressure is applied.

DISCLOSURE OF THE INVENTION

One purpose of the present invention is thus to overcome at least partially the abovementioned drawbacks, related to implementations of prior art.

To do this, one object of the invention is a control button of a manually actuated sampling pipette, said button comprising a lower part as well as an upper part defining a pressure external surface for an operator's thumb, one of said lower and upper parts being equipped with a force sensor centred on a central axis of the button, and the other of said lower and upper parts of the button including an actuating member centred on the central axis of the button and intended to transmit a force to the force sensor when the operator exerts a pressure on the upper part of the button.

In addition, in a vertical position of the button, in a state not biased by the operator, on the one hand the actuating member ensures axial holding of the upper part on the lower part of the button, and on the other hand the upper and lower parts of the button define an axially retaining circular connection therebetween, said circular connection having an axial clearance configured such that during a pressure by the thumb of an operator on an action zone of the upper part which is off-centred relative to said central axis of the button, said axial clearance is taken up wholly or partly at the action zone, whereas said circular connection axially and locally retains, with respect to the lower part, a reaction zone of the upper part arranged diametrically opposite said action zone relative to the central axis.

The invention enables detection reliability to be improved, first because the force transmitted by the actuating member to the sensor is centred on the same sensor, even for an off-centred pressure by the operator's thumb. Further, the upper part of the button thus acts as a lever arm pivoting at its reaction zone opposite the action zone and between which the actuating member is located, the force of which is then amplified relative to that delivered by the thumb. This specificity peculiar to the invention is advantageous when the desired application requires a high detection threshold. In addition, this lever arm principle advantageously operates regardless of the angular position of the action zone on the upper part of the button.

Besides, the invention presents at least any of the following optional characteristics, taken alone or in combination.

The upper part is rotatably mounted to said lower part, along the central axis.

Said actuating member forms a ball pivot element between the upper part and the lower part of the button.

Said actuating member has a generally semi-spherical shape.

Said upper part has a generally dome shape.

Said axially retaining circular connection is arranged on or in the proximity of a peripheral zone of said lower and upper parts of the button. However, this connection could be more centred on the central axis of the button, without departing from the scope of the invention. However, it is indicated that the off-centring of this connection enables the amplification of the force delivered by the actuating member to the force sensor to be increased, which contributes to further improving the detection reliability.

Said axially retaining circular connection is formed using a flange equipping the lower part and projecting radially outwardly, and a throat equipping the upper part and receiving said flange, said throat being radially inwardly open. A reverse configuration is of course possible, without departing from the scope of the invention.

The button comprises a force transfer plate arranged between the actuating member and the force sensor, said plate being centred on the central axis of the button. This plate enables the pressure on the sensor to be evenly distributed, for the purpose of obtaining a signal of a maximum intensity at the output of this sensor.

In this regard, preferably, said force transfer plate has an area accounting for at least 80% of the active area of the force sensor.

Said force transfer plate has a housing for receiving said actuating member. This housing thus makes up the other ball pivot element, for cooperating with the actuating member.

The control button comprises an elastomeric layer between said force transfer plate and the force sensor.

The control button comprises an electronic device connected to said force sensor, said force sensor preferably continuously delivering a signal to the electronic device, said signal having an intensity as a function of the force detected by the force sensor. Alternatively, said electronic device could be housed in another member of the pipette, without departing from the scope of the invention.

Said electronic device is designed to perform at least one of the following actions:

- storing the data related to the signals delivered by the force sensor, such as date, time, intensity, etc. Preferably, this storage is essentially provided for counting the number of pipetting cycles performed by the pipette;
- commanding an action following receiving a signal from the force sensor reaching a threshold value, for example the measurement of a physical datum such as a pressure, temperature, mass of sampled liquid, etc., and/or the incrementation of a counter of the number of pipetting operations;
- commanding a display modification on a screen provided on the pipette. For example, the display can indicate the number of pipetting operations since the last zero setting;
- transmitting by a wireless communication, via a transmitter, a transmission signal to a receiver located remote from the pipette. Here, it can be a receiver equipping any type of device likely to communicate remotely with the pipette, such as a liquid dispensing assistance light device in the wells of at least one titration microplate, intended to bear on this light device.

Finally, the button also preferably integrates an electric power supply, even if once again this power supply could be housed in another member of the pipette, without departing from the scope of the invention.

Another object of the invention is also a manually actuated sampling pipette, comprising a control rod the bottom end of which controls the movement of a piston slidably housed in a suction chamber of the pipette, the top end of the control rod carrying a control button as described above, said control button being intended to be moved by an actuating pressure of an operator such that the piston successively performs a dispensing stroke during which first elastic return means are loaded, and then a purging stroke during which second elastic return means are loaded.

In this case, it is for example possible to conduct the detection of the passage of the piston through a predetermined position along its dispensing stroke or its purging stroke, in which position said first and/or second elastic return means have a predetermined deformation level. Indeed, it is possible to associate a deformation level of the first and/or second elastic return means with a force value viewed by the sensor implanted in the button. In this way, in use, the detection of the same force value by the sensor indicates that the piston is in the predetermined position along its stroke, which position is obtained upon deforming the first and/or second elastic means according to the above-mentioned deformation level.

This detection can be used in many applications, such as counting the number of pipetting cycles, this number being possibly stored in a memory and/or displayed on the pipette, but also the possibility to command any action following detection of the passage of the piston through the predetermined position, or even transmitting a signal intended to be received by any device provided to communicate remotely from the pipette. Within this scope, any wireless connection type can be contemplated, without departing from the scope of the invention.

It is to be noted that the predetermined piston position is chosen depending on desired applications. It can also be retained at any place between the start of the dispensing stroke and the end of the purging stroke, including the bottom point of this purging stroke.

Preferably, said first and second elastic return means are compression springs, as is conventionally the case in current manually actuated pipettes.

Preferably, said predetermined position of the piston corresponds to the transition position between the dispensing stroke and the purging stroke, or even to a position in the proximity of this transition position. If other positions are contemplatable, the transition position turns out to be particularly suitable when aiming at detecting that a liquid dispensing has actually entirely been made.

By way of indicating example, the invention is applicable to a system comprising a sampling pipette as described above, as well as a liquid dispensing assistance light device in the wells of at least one titration device intended to bear on the light device, the latter being designed to successively light said wells responsive to transmission signals transmitted by a wireless connection by said electronic device of the pipette. Once again, the wireless connection can be of any type known to those skilled in the art, for example RF, optical, etc.

Further advantages and characteristics of the invention will appear in the non-limiting detailed description below.

BRIEF DESCRIPTION OF THE DRAWINGS

This description will be made with regard to the appended drawings in which.

DETAILED DESCRIPTION OF PREFERRED EMBODIMENTS

Figure 1:
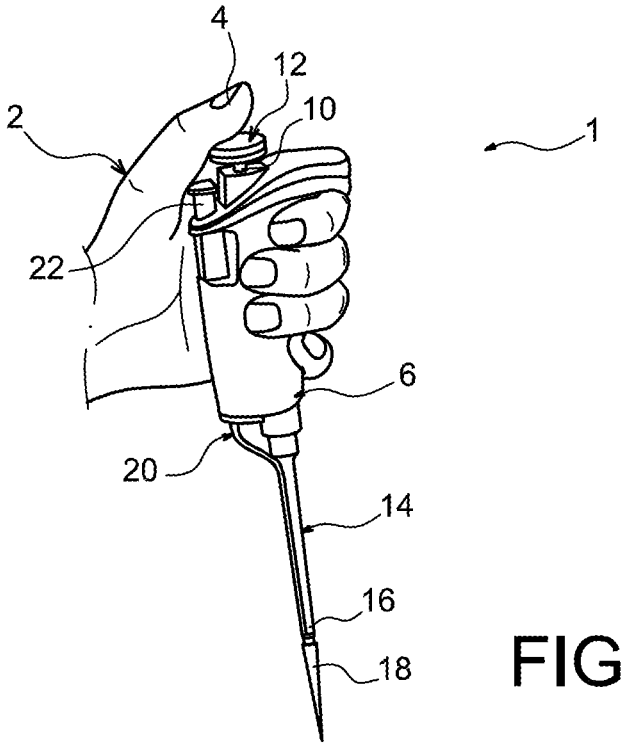
FIG. 1 represents a perspective view of a manually actuated sampling pipette according to the present invention, when actuated by an operator.

In reference to FIG. 1, a manually actuated sampling pipette 1 is represented, which is held by the hand 2 of an operator who using his/her thumb 4, actuates the pipette to generate dispensing a liquid which has been sucked beforehand.

More precisely, the pipette 1 comprises a handle 6 forming an upper body of the pipette, handle from which a control rod 10 opens, carrying at its top end, in a pipetting position, a control button 12 the upper part of which is intended to undergo the pressure of the operator's thumb. By way of indicating purposes, it is noted that a display screen (not represented) can be provided on the handle 6.

Under the handle 6, the pipette 1 includes a removable bottom part 14, which ends down by a cone-carrying tip 16 receiving a consumable 18, also called a sampling cone. In a known manner, after pipetting, the cone can be mechanically ejected by an ejector 20 the actuating button 22 of which is also projecting from above the handle, in the proximity of the control button 12.

Figure 2:
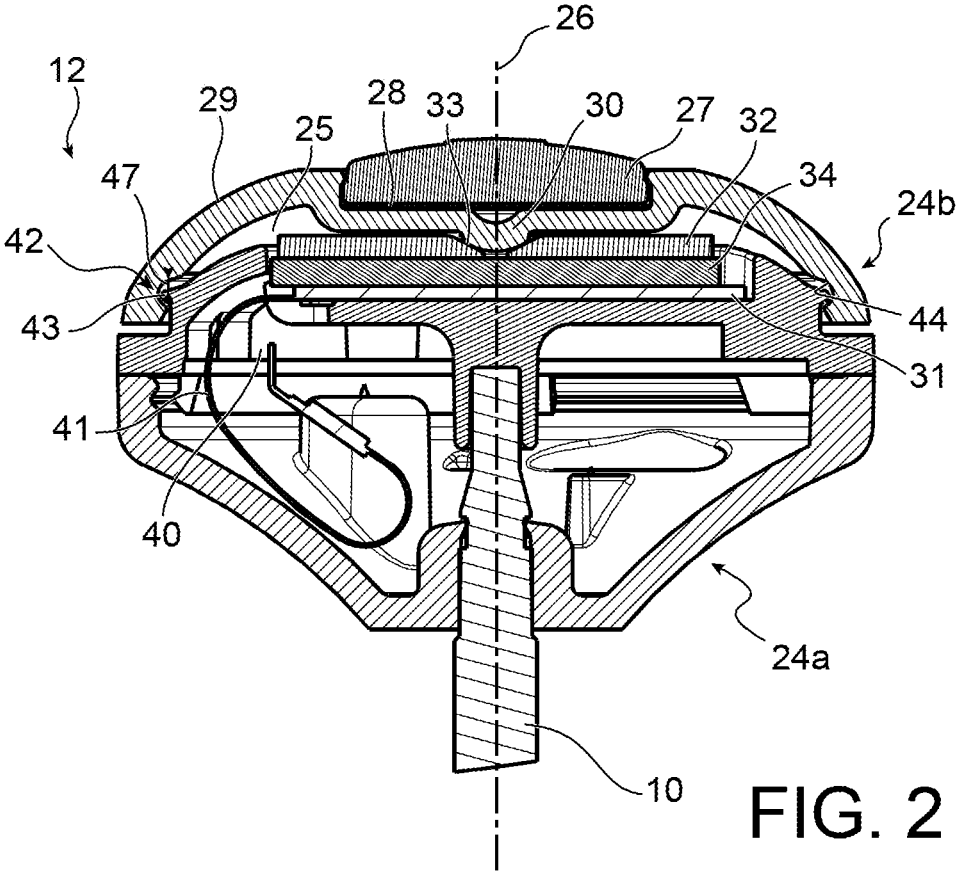
FIGS. 2 to 4 respectively represent the button of the pipette of the preceding figure, its central part, and its lower part.

In reference to FIG. 2, the control button 12, according to a preferred embodiment of the invention, is represented in greater detail.

Overall, it comprises a lower part 24*a* as well as an upper part 24*b* both centred on a central axis 26 of the button, corresponding to the longitudinal axis of the pipette. In this regard, it is noted that all the elements of the pipette that will be described hereinafter are centred on the same axis 26. Both parts 24*a*, 24*b* are substantially of revolutionary shapes, and delimit between them an internal space 25 in which functional elements, which will be described hereinafter, are housed.

At its bottom end, the lower part 24*a* is sewed to the control rod 10, whereas its top end is connected to the dome shaped upper part 24*b*, closing the button 12. As is visible in FIG. 2, the dome 24*b* can be equipped at its upper end with a cap 27, preferably click-in assembled in an indentation 28.

More precisely, the dome 24*b* has its hollow space downwardly oriented, thus has a generally upwardly bulged shape intended to undergo the pressure applied by the operator's thumb, upon pipetting. In other words, the dome 24*b* has a pressure external surface 29 on which the operator directly exerts the actuating pressure, during a pipetting operation.

The internal space 25 contains means for detecting a passage of the pipette piston through a predetermined position, as will be detailed hereinafter. In the embodiment represented, the abovementioned means are all integrated to the button 12, first with an actuating member 30 centred on the axis 26 and having generally for example a low diameter semi-spherical shape, or even that of a downwardly oriented pin.

Further, the lower part 24*a* supports a force sensor 31, preferably a planar sensor. Although not represented, it would be possible to implement a reversed configuration in which the pin would be integrated to the lower part 24*a*, whereas the sensor 31 would be integral with the upper part 24*b*.

In all cases, the member 30, hereinafter called a pin, is intended to transmit a force to the sensor 31 when the operator exerts a pressure on the upper part of the button.

In the embodiment represented, a force transfer plate 32 cooperates with the pin 30. This plate 32, preferably of ceramics or metal, has a low thickness, and includes a central housing 33 receiving the pin 30. Both these elements 30, 33 form together a ball pivot between the lower 24*a* and upper 24*b* parts, allowing not only a relative rotation about the axis 26, but also a low amplitude swing, as will be detailed hereinafter.

The force transfer plate 32 has an area accounting for at least 80% of the active area of the sensor 31, so as to evenly distribute pressure on the sensor, and thus for the purpose of obtaining a signal with a maximum intensity at the output of this sensor 31. Preferably, an elastomeric layer 34 is interposed between the sensor 31 and the plate 32, these elements being integral with each other. This layer 34 ensures a force distributing function between the rigid plate 32 and the sensor 31.

The internal space 25 also contains an electronic device 40, which overall comprises a microprocessor and a transceiver. This device 40 is powered by a battery (not represented) located under the device.

The electronic device 40 continuously receives the signal delivered by the sensor 31, via an electrical cable 41. The intensity of this signal delivered to the device 40 is naturally proportional to the force exerted by the operator's thumb, on the pressure external surface 29 of the button.

Further, an axially retaining circular connection 42 is provided between both parts 24*a*, 24*b*, this connection being arranged on or in the proximity of a peripheral zone of the same parts.

The circular connection 42 is formed using a flange 43 provided on the lower part 24*a*, this flange 43 projecting radially outwardly. It is received in a throat 44 provided on the internal surface of the dome 24*b*, this throat being radially inwardly open. The flange 43 and the throat 44 have substantially homothetic, preferably substantially circular, shapes.

In a vertical position of the bottom 12 and in a state in which the latter is not biased by the operator as is represented in FIG. 2, it is the pin 30 bearing in the housing 33 which ensures axial holding of the upper part 24*b* on the lower part of the bottom 24*a*. Thus, it is the single contact zone between both parts, since the circular connection 42 is configured to have an axial clearance 47 between the flange 43 and the upper wall of the throat 44. This clearance 47 is for example lower than 1 mm, for example a few tenths of millimetres, and substantially identical throughout the circular connection 42. An axial clearance can also be provided between the flange 43 and the lower wall of the throat 44, but with a much lower value than the clearance 47, or even with a zero value.

Figure 3:
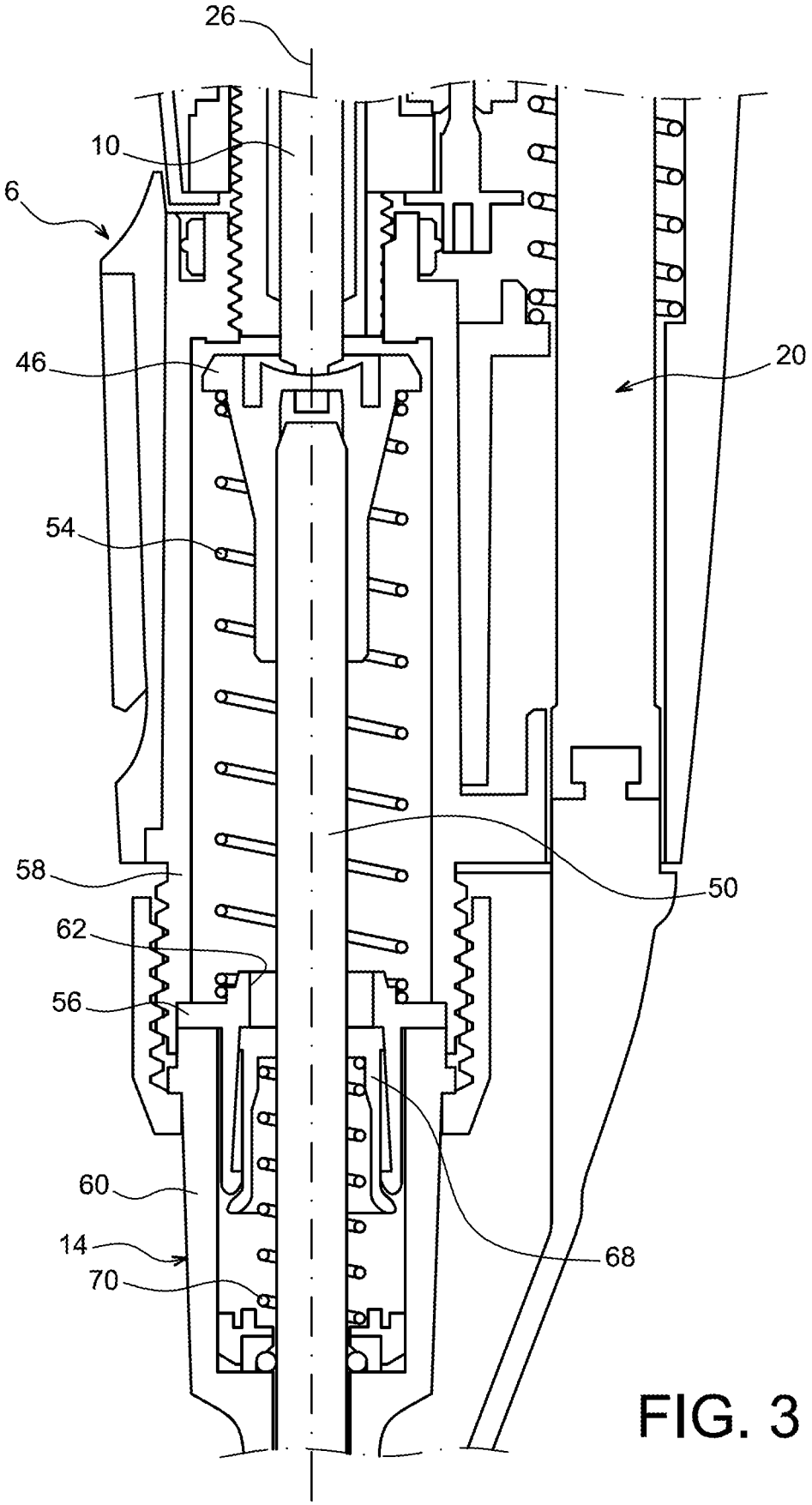

In reference now to FIG. 3, a central part of the pipette is represented, comprising a portion of the handle 6 as well as a portion of the bottom part 14. The design retained is of the conventional type and known to those skilled in the art, and will consequently be only briefly described.

Figure 4:
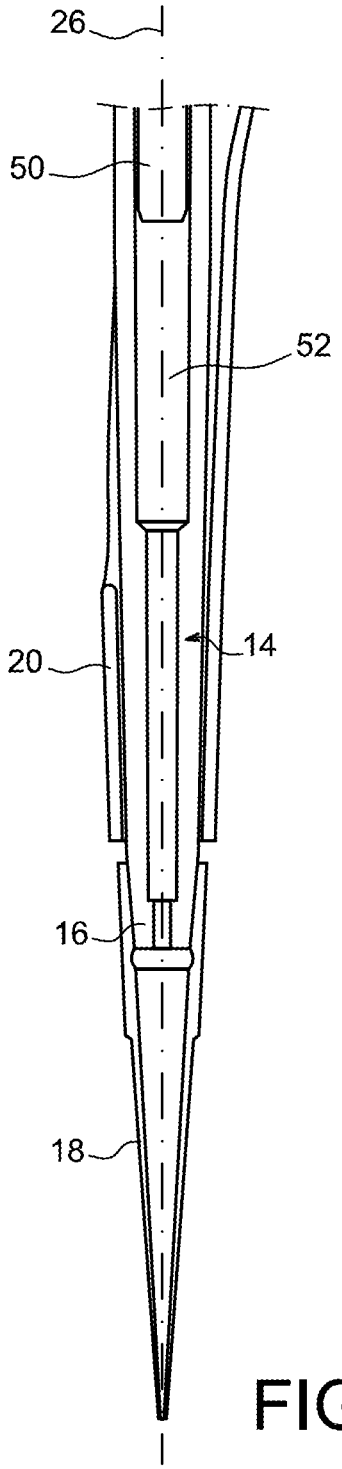

In the top part, the bottom end of the control rod 10 is surrounded by a device for setting the volume to be sampled, known per se. This bottom end contacts a seat forming piece 46, integral with the top end of a piston 50 the bottom end of which is housed within a suction chamber 52 shown in FIG. 4, communicating with inside the sampling cone 18.

The piston 50, slidably movable along the direction of the axis 26 in the suction chamber, is held in the top position by a first compression spring 54 the top end of which bears against a shoulder of the seat 46, and the bottom end of which bears against the shoulder of another seat 56 arranged in the proximity of the junction between the handle 6 and the bottom part 14. The seat 56 is integral with the fixed shell 58 of the handle, and also integral with the fixed shell 60 of the bottom part 14. The first spring 54 is commonly called a liquid dispensing spring.

The seat 56 has a port 62 through which the piston 50 passes. On the same seat 56, a downwardly oriented shoulder translationally stops a ring 68 held in a top position by a second compression spring 70 the bottom end of which bears in the bottom of the shell 60. The second spring 70 is commonly called a purging spring. It has a spring rate higher than that of the dispensing spring 54.

The abovementioned detection means are herein shaped so as to detect the passage of the piston 50 through the end of dispensing stroke position, that is at the transition between both strokes, just before the second spring 70 has started to be deformed. A level force of the pin 30 onto the sensor 31 corresponds to this deformation level of the first spring 54. Consequently, the device 40 is capable of detecting that the piston 50 has reached its end of dispensing stroke position, when it receives from the sensor 31 a signal with an intensity corresponding to the abovementioned force level.

Thus, during a dispensing operation, the operator holding the handle 6 in the hand exerts using his/her thumb an actuating pressure on the external surface 29 of the bottom. That leads to move downwardly the control rod 10, which drives the piston therewith, by virtue of bearing on the seat 46. During the start of this dispensing stroke, the first spring 54 is loaded by being compressed, but the pressure applied by the thumb onto the bottom 12 only generates a small force from the pin 30 to the sensor 31. The device 40, as it receives a signal with a low intensity from the sensor 31, understands that the end of dispensing stroke position has not been reached yet.

Figure 5:
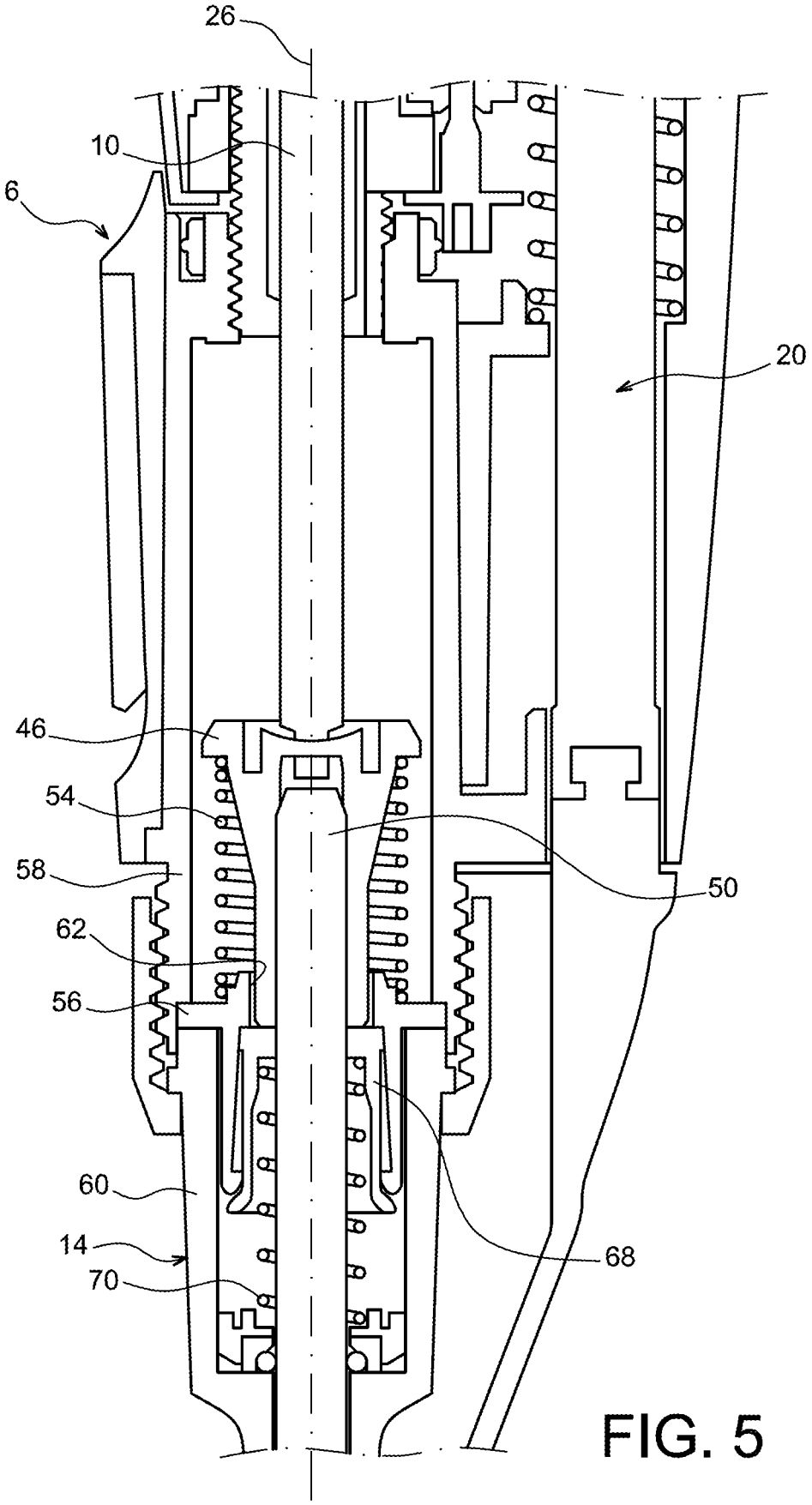
FIGS. 5 and 6 represent the pipette according to different configurations assumed during a pipetting operation.

On the other hand, when the first spring 54 reaches the predetermined deformation level placing the piston 50 at the end of the dispensing stroke, as is represented in FIG. 5, the pressure applied by the thumb on the bottom 12 is significant and generates a high force from the pin 30 to the sensor 31. The device 40, since it receives a signal with a high intensity from the sensor 31, understands that the end of the dispensing stroke position is reached.

Figure 6:
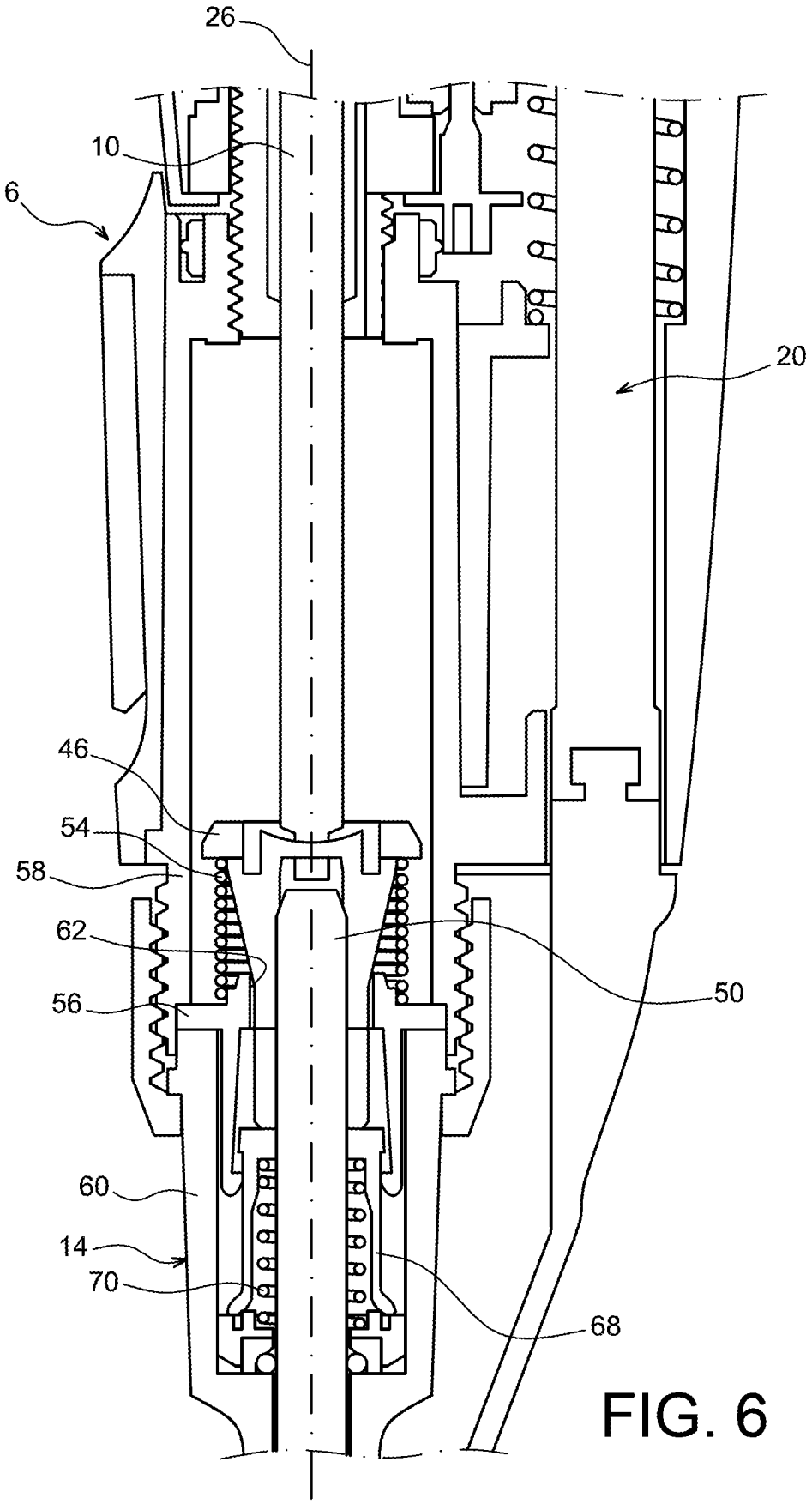

Then, the operator continues to increase pressure on the bottom to perform the purging stroke generating compression of the second spring 70, until the piston has arrived at a bottom point represented in FIG. 6. It is noted that during this purging stroke, the first spring continues to be gradually loaded. As regards the second spring 70, its compression is generated by the seat 68 pressing against a sleeve downwardly extending from the seat 46 and passing through the port 62.

Once the pipetting operation is ended, the operator releases pressure, which leads the different elements to be successively unloaded in the reverse order to that described above.

Figure 7:
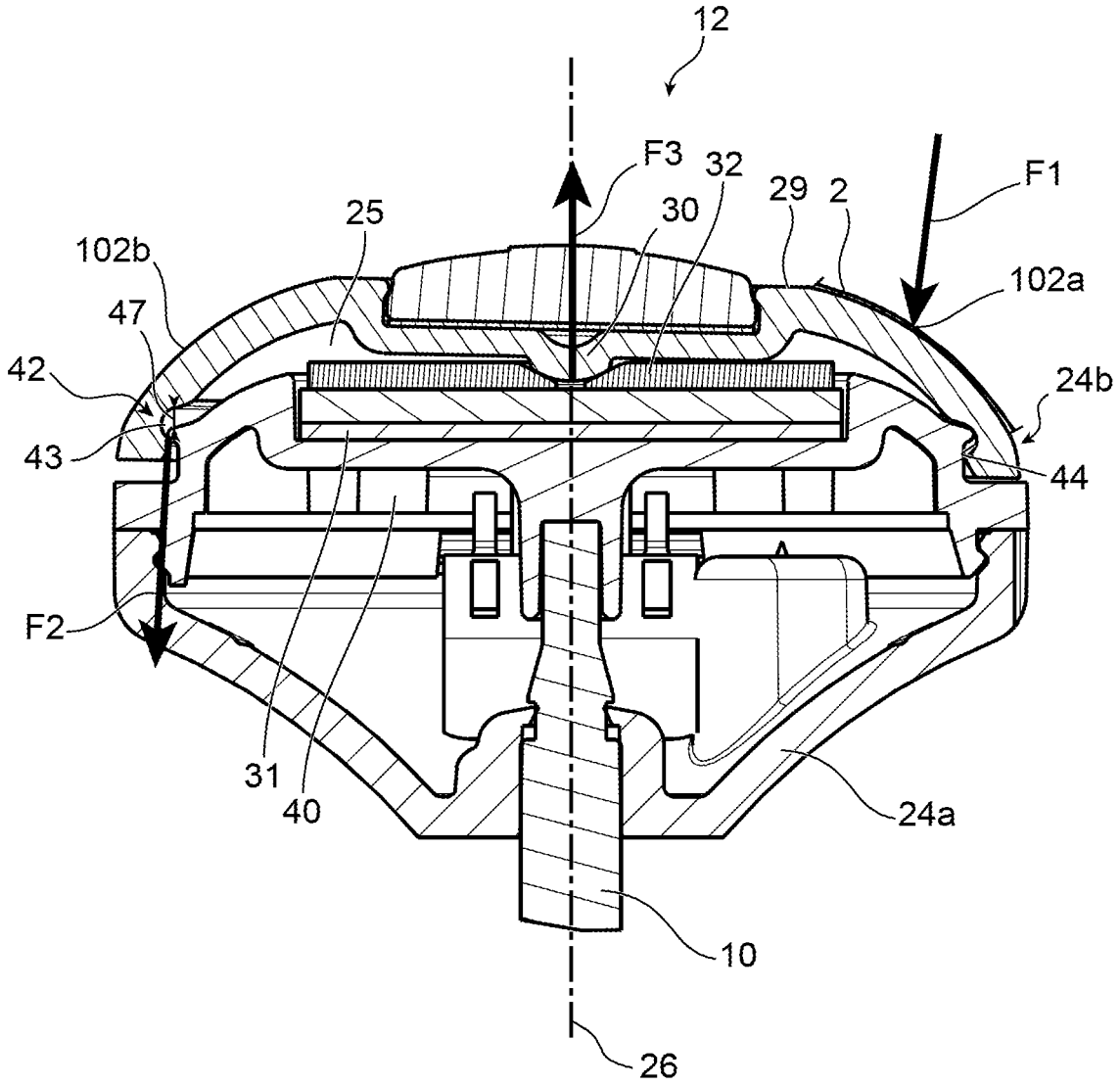
FIG. 7 represents a view of the button during a liquid dispensing operation.

In reference now to FIG. 7, one of the features of the invention is shown, making it possible to benefit from a great detection reliability using the sensor 31. Indeed, this detection reliability first results from the centred character of the pin 30, which enables the sensor 31 to be biased in a centred manner even when the operator thumb 2 acts on an off-centred action zone 102*a*. This off-centred action zone 102*a* corresponds to a portion of the dome 24*b* which usually extends up to a peripheral portion of this dome.

During a liquid dispensing stroke aiming at moving the bottom 12 and the piston downwardly, at the action zone 102*a*, the axial clearance 47 of the circular connection 42 is locally wholly or partly taken up, to possibly become zero or close to zero as has been represented on the right part of FIG. 7. At the same time, because of the pivoting of the dome 24*b* along the pin 30, the circular connection 42 becomes locally active at a reaction zone 102*b* arranged diametrically opposite the action zone 102*a*, relative to the central axis 26. In other words, at this reaction zone 102*b* of the dome 24*b*, the circular connection 42 axially and locally retains the dome 24*b* with respect to the lower part 24*a*. This axial retaining is quickly performed after the possible low clearance between the flange 43 and the lower wall of the throat 44, at the reaction zone 102*b*, is taken up.

Consequently, upon actuating the bottom 12, its dome 24*b* fulfils a lever arm function from its reaction zone 102*b*, in the proximity of which the dummy lever hinge axis is located. In this configuration, the dome 24*b* is subjected to three forces, that is a force F1 exerted by the operator thumb 2 on the action zone 102*a*, a reaction force F2 exerted by the flange 43 onto the reaction portion 102*b* of the dome, as well as a force F3 applied on the pin 30 by all the lower movable elements of the pipette, these forces F3 resulting from the action of the springs 54, 70.

Thanks to this lever arm effect, the force F3 applied to the pin 30 is higher than the force F1, farther from the dummy hinge axis. That enables the force transmitted to the sensor 31 to be enhanced and thus one or more higher detection values, promoting a better detection reliability, to be assumed.

During the pipetting operation, when the signal delivered by the sensor 31 to the electronic device 40 reaches a value which reflects a passage of the piston through the predetermined position, several actions can be generated, such as those previously described. Among these actions, one of the favoured ones resides in transmitting, via a wireless connection and through the transmitter, a transmission signal to a receiver remotely located from the pipette.

Figure 8:
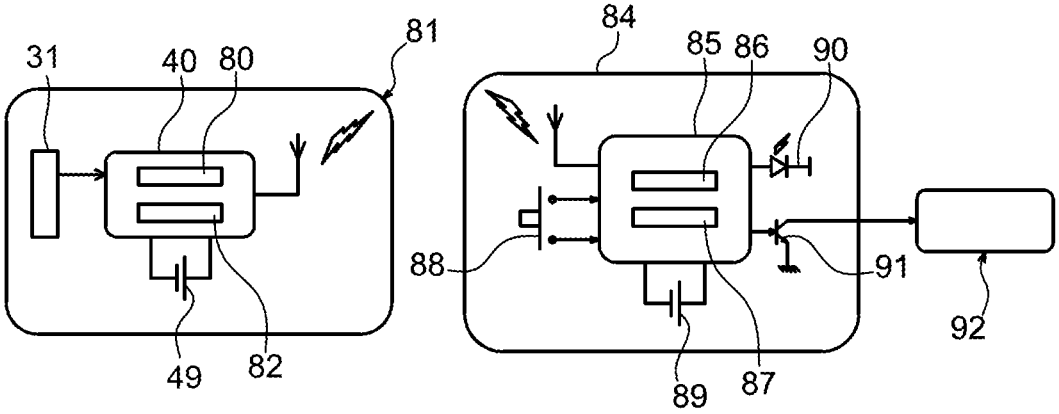
FIG. 8 is a scheme showing the different components of the pipette enabling transmission signals to be delivered, as well as the different components for equipping a device remotely from the pipette to receive transmission signals.

FIG. 8 shows an example of equipment allowing such a wireless communication, here by RF radiofrequency. The detection means 81 equipping the pipette button have already been described above. They comprise the electronic device 40 provided with the microprocessor 80 and the transceiver 82. They also include the force sensor 31 continuously delivering a signal to the device 40, and an electric power supply battery 49. The receiver 84, provided on a device arranged remotely from the pipette and intended to communicate with the same, comprises an electronic device 85 provided with a microprocessor 86 and a transceiver 87. It also includes a peering control 88, an electrical power supply battery 89, and possibly a LED 90 for the receiver status. Moreover, a circuitry 91, for example of the USB type, enables it to be connected to the remote device 92, which is here preferably a pipetting assistance light device represented in FIG. 9.

Figure 9:
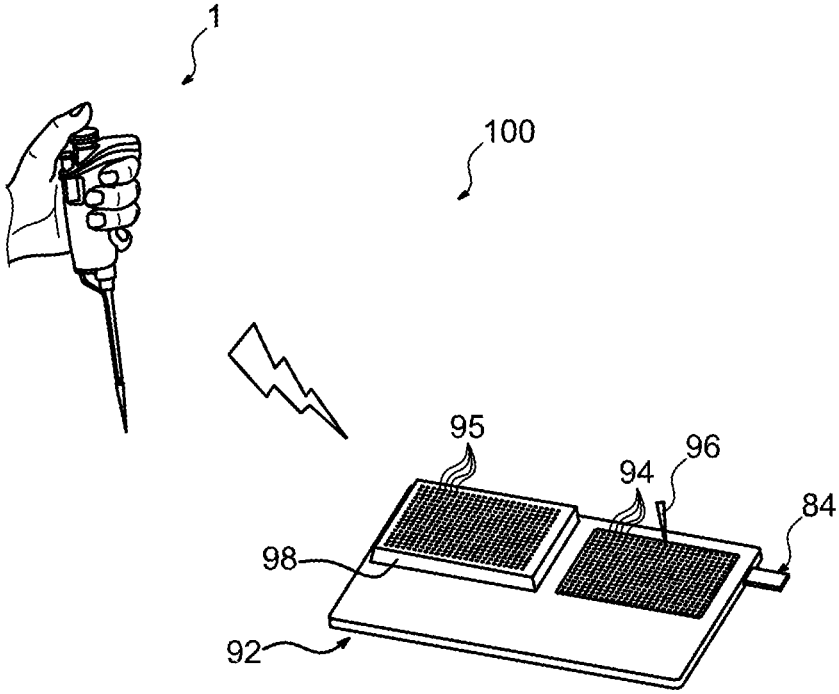
FIG. 9 represents a system comprising a sampling pipette as well as a liquid dispensing assistance light device in the wells of at least one titration intended to bear on the light device.

Indeed, this FIG. 9 shows a system 100 comprising the pipette 1 and the liquid dispensing assistance light device 92 in the wells of at least one titration device, intended to bear on this light device in a known manner per se. It is for example a microplate 98, such as that laid on the left part of the light device 92 of FIG. 9. The latter is intended to communicate wirelessly with the pipette, by RF by virtue of the means described in FIG. 8.

In a way known to those skilled in the art, the liquid sampled by a pipette can be dispensed in the wells of the titration microplate 98 bearing on the upper surface of the light device, having a matrix of light spots 94 corresponding to the matrix formed by the wells 95 on the microplate. The liquid is then successively dispensed on the different wells, which are very numerous and of a small dimension. In order to limit error risks from the operator, the device 92 generally consists in illuminating, via the suitable light spot 94, the well that should be filled, after the light spot 94 of the previously liquid filled well has been turned OFF. The lighting is for example performed by LEDs located under the microplate, being at least partially transparent.

Usually, the operator has a pedal control to command the movement of lighting from one well to the other. The control pedal is then actuated after each well is filled. With the present invention, the successive lighting of the wells, according to a preset order stored by the microplate, is automatically operated after transmitting each transmission signal received by the receiver 84, connected to the light device 92. In other words, during pipetting, as soon as the signal delivered by the sensor exceeds a threshold value, the succession of events described above occurs, up to see a change in the light 96 which then illuminates the following well to be filled. Of course, other illumination configurations are contemplatable without departing from the scope of the invention.

Of course, various modifications can be provided by those skilled in the art to the invention just described, only by way of non-limiting examples. In this respect, it is noted that the invention can also be useful for tracking the sucking stroke. For example, as a function of the force detected by the sensor during the piston descent for a liquid sucking operation, the operator can be notified of the correctness of this stroke which is also performed by counteracting the return force of the first spring. The aim here is that the operator is informed when the suction stroke has not been long enough, or otherwise when it has been too long up to partly compress the second return spring. In the same way, a pipetting stroke assistance could be implemented during which the operator would receive, at the corresponding instant, a piece of information according to which the pipetting stroke should be stopped.

The invention claimed is:

1. A control button of a manually actuated sampling pipette, said button comprising a lower part as well as an upper part defining a pressure external surface for a thumb of an operator, one of said lower part and said upper part being equipped with a force sensor centered on a central axis of the button, wherein the other of said lower part and said upper part of the button includes an actuating member centered on the central axis of the button and intended to transmit a force to the force sensor when the operator exerts a pressure on the upper part of the button, and in that in vertical position of the button, in a state not biased by the operator, on the one hand the actuating member ensures axial holding of the upper part on the lower part of the button, and on the other hand the upper part and the lower part of the button define an axially retaining circular connection therebetween, said axially retaining circular connection having an axial clearance configured such that during a pressure by the thumb of the operator on an action zone of the upper part which is off-centered relative to said central axis of the button, said axial clearance is taken up wholly or partly at the action zone, whereas said axially retaining circular connection axially and locally retains, with respect to the lower part, a reaction zone of the upper part arranged diametrically opposite said action zone relative to the central axis.

2. The control button according to claim 1, wherein the upper part is rotatably mounted to said lower part, along the central axis.

3. The control button according to claim 1, wherein said actuating member forms a ball pivot element between the upper part and the lower part of the button.

4. The control button according to claim 1, wherein said actuating member has a generally semi-spherical shape.

5. The control button according to claim 1, wherein said upper part has a generally dome shape.

6. The control button according to claim 1, wherein said axially retaining circular connection is arranged on or in the proximity of a peripheral zone of said lower part and said upper part of the button.

7. The control button according to claim 1, characterised in wherein said axially retaining circular connection is formed using a flange equipping the lower part and projecting radially outwardly, and a throat equipping the upper part and receiving said flange, said throat being radially inwardly open.

8. The control button according to claim 1, further comprising a force transfer plate arranged between the actuating member and the force sensor, said plate being centered on the central axis of the button.

9. The control button according to claim 8, wherein said force transfer plate has an area accounting for at least 80% of the active area of the force sensor.

10. The control button according to claim 8, wherein said force transfer plate has a housing for receiving said actuating member.

11. The control button according to claim 8, further comprising an elastomeric layer between said force transfer plate and the force sensor.

12. The control button according to claim 1, further comprising an electronic device connected to said force sensor, said force sensor delivering a signal to the electronic device, said signal having an intensity as a function of the force detected by the force sensor.

13. The control button according to claim 12, wherein said electronic device is designed to perform at least one of the following actions:

storing data related to the signal delivered by the force sensor;

commanding an action following receiving a signal from the force sensor reaching a threshold value;

commanding a display modification on a screen provided on the pipette; and transmitting by a wireless connection, via a transmitter, a transmission signal to a receiver located remote from the pipette.

14. The control button according to claim 13, wherein said action is a measurement of a physical datum and/or an incrementation of a counter of a number of pipetting operations.

15. The control button according to claim 12, wherein said force sensor continuously delivers said signal to the electronic device.

16. The control button according to claim 1, further comprising an electric power supply.

17. A manually actuated sampling pipette, comprising a control rod having a bottom end and a top end, the bottom end of which controls the movement of a piston slidably housed in a suction chamber of the pipette, the top end of the control rod carrying a control button according to claim 1, said control button being intended to be moved by an actuating pressure of the operator such that the piston successively performs a dispensing stroke during which first elastic return means are loaded, and then a purging stroke during which second elastic return means are loaded.

* * * * *